US012006633B2

(12) United States Patent
Backfolk et al.

(10) Patent No.: US 12,006,633 B2
(45) Date of Patent: Jun. 11, 2024

(54) METHOD FOR COATING A FIBROUS WEB, AND A SURFACE COATED FIBROUS WEB

(71) Applicant: Stora Enso OYJ, Helsinki (FI)

(72) Inventors: Kaj Backfolk, Lappeenranta (FI); Isto Heiskanen, Imatra (FI); Otto Nylén, Helsinki (FI)

(73) Assignee: Stora Enso OYJ, Helsinki (FI)

( * ) Notice: Subject to any disclaimer, the term of this patent is extended or adjusted under 35 U.S.C. 154(b) by 164 days.

(21) Appl. No.: 17/757,257

(22) PCT Filed: Dec. 22, 2020

(86) PCT No.: PCT/IB2020/062323

§ 371 (c)(1),
(2) Date: Jun. 13, 2022

(87) PCT Pub. No.: WO2021/130667

PCT Pub. Date: Jul. 1, 2021

(65) Prior Publication Data

US 2023/0002976 A1 Jan. 5, 2023

(30) Foreign Application Priority Data

Dec. 23, 2019 (SE) ..... 1951552-7

(51) Int. Cl.
*D21H 23/24* (2006.01)
*D06B 1/10* (2006.01)
(Continued)

(52) U.S. Cl.
CPC ..... *D21H 23/24* (2013.01); *D06B 1/10* (2013.01); *D06M 13/02* (2013.01); *D06M 13/10* (2013.01);
(Continued)

(58) Field of Classification Search
CPC ..... D21H 23/24; D21H 19/16; D21H 19/28; D21H 19/66; D21H 27/02; D21H 11/18;
(Continued)

(56) References Cited

U.S. PATENT DOCUMENTS 2,121,005 A * 6/1938 Bener ..... D06M 15/423 26/69 R
2,161,223 A * 6/1939 Bener ..... D06Q 1/08 26/69 R
(Continued)

FOREIGN PATENT DOCUMENTS

CN 1665982 A 9/2005
CN 101473090 A 7/2009
(Continued)

OTHER PUBLICATIONS

Extended European Search report from corresponding European application No. 20904498.1 dated Nov. 16, 2023.
(Continued)

*Primary Examiner* — Jose A Fortuna
(74) *Attorney, Agent, or Firm* — Greer, Burns & Crain, Ltd.

(57) ABSTRACT

A method is provided for coating a fibrous web, in particular a fibrous web comprising nanocellulose fibres. The method includes steps of applying a coating agent to a textured surface region of a textured substrate, applying a fibre furnish or a wet fibrous web onto the coated textured surface region of the textured substrate, optionally dewatering to provide a wet fibrous web, and drying said wet fibrous web such that at least a portion of said coating agent is transferred to said fibrous web. The method provides a coated fibrous web with improved barrier properties.

19 Claims, 1 Drawing Sheet

(51) Int. Cl.

| | |
|---|---|
| ***D06M 13/02*** | (2006.01) |
| ***D06M 13/10*** | (2006.01) |
| ***D06M 13/188*** | (2006.01) |
| ***D06M 15/17*** | (2006.01) |
| ***D06M 15/227*** | (2006.01) |
| ***D06M 101/06*** | (2006.01) |
| ***D21F 11/00*** | (2006.01) |
| ***D21H 19/16*** | (2006.01) |
| ***D21H 19/28*** | (2006.01) |
| ***D21H 19/66*** | (2006.01) |
| ***D21H 27/02*** | (2006.01) |

(52) U.S. Cl.
CPC ..... *D06M 13/188* (2013.01); *D06M 15/17* (2013.01); *D06M 15/227* (2013.01); *D21F 11/006* (2013.01); *D21H 19/16* (2013.01); *D21H 19/28* (2013.01); *D21H 19/66* (2013.01); *D21H 27/02* (2013.01); *D06M 2101/06* (2013.01)

(58) Field of Classification Search
CPC ..... D21H 21/16; D21H 23/52; D21H 23/56; D21H 19/12; D21H 17/17; D06M 13/02; D06M 13/10; D06M 13/188; D06M 15/17; D06M 15/227; D06M 2101/06; D06B 1/10; D21F 11/006; B05C 9/14; B05C 1/14; B05D 2501/10; B05D 7/04; B05D 3/0254; B05D 1/286; B32B 3/28; B32B 2307/724; B32B 2307/73; C08J 5/18
See application file for complete search history.

(56) References Cited

U.S. PATENT DOCUMENTS

| | | | | |
|---|---|---|---|---|
| 4,138,945 | A * | 2/1979 | Rejto | D06C 23/04 427/272 |
| 5,223,092 | A | 6/1993 | Grinnell et al. | |
| 6,547,924 | B2 * | 4/2003 | Klerelid | D21F 11/006 162/358.4 |
| 10,927,504 | B2 | 2/2021 | Backfolk et al. | |
| 2002/0062936 | A1 * | 5/2002 | Klerelid | D21F 11/006 162/116 |
| 2002/0152630 | A1 | 10/2002 | Lindsay et al. | |
| 2004/0028826 | A1 | 2/2004 | Goecke et al. | |
| 2005/0251976 | A1 | 11/2005 | Lipponen et al. | |
| 2016/0194830 | A1 | 7/2016 | Hammond et al. | |
| 2022/0104974 | A1 * | 4/2022 | Arora | A61F 13/49007 |
| 2023/0002976 | A1 * | 1/2023 | Backfolk | D06M 13/10 |
| 2023/0138090 | A1 * | 5/2023 | Kien | B32B 7/08 428/103 |

FOREIGN PATENT DOCUMENTS

| | | | | | |
|---|---|---|---|---|---|
| CN | 109415875 | B | | 12/2021 | |
| CN | 114929965 | B | * | 6/2023 | B05D 1/286 |
| CN | 116602820 | A | * | 8/2023 | A61F 13/47 |
| EP | 1478805 | A1 | | 11/2004 | |
| GB | 2515843 | A | | 1/2015 | |
| JP | 2023507743 | A | * | 2/2023 | D06M 13/02 |
| WO | 9847628 | | | 10/1998 | |
| WO | 2018007673 | A1 | | 1/2018 | |
| WO | 2019198040 | A1 | | 4/2019 | |
| WO | WO-2021130667 | A1 | * | 7/2021 | B05D 1/286 |
| WO | WO-2023204835 | A1 | * | 10/2023 | D06M 15/333 |

OTHER PUBLICATIONS

International Search Report from corresponding PCT application No. PCT/IB2020/062323 dated Mar. 2, 2021.

* cited by examiner

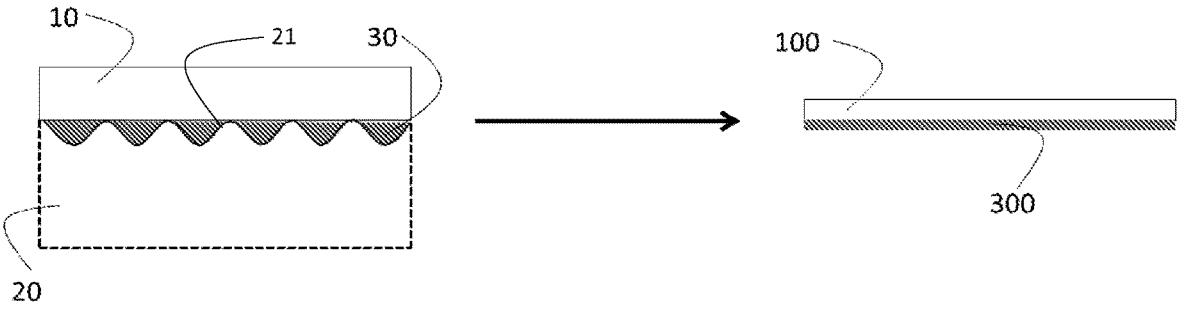
10
21
30
20
100
300

METHOD FOR COATING A FIBROUS WEB, AND A SURFACE COATED FIBROUS WEB

This application is a U.S. National Phase under 35 U.S.C. § 371 of International Application No. PCT/IB2020/062323, filed Dec. 22, 2020, which claims priority under 35 U.S.C. §§ 119 and 365 to Swedish Application No. 1951552-7 filed Dec. 23, 2019.

TECHNICAL FIELD

A method is provided for coating a fibrous web, in particular a fibrous web comprising nanocellulose fibres. The method provides a coated fibrous web.

BACKGROUND

Most coating and surface treatments of fibrous webs—such as blade coating, film and size presses or various coatings made with printing and other contact and non-contact deposition techniques—are carried out on dry fibrous webs.

Traditionally, most coating methods for paper and paperboards are aiming to enhance optical and printing properties, whereas barrier properties are not considered. In order to achieve an effective gas/aroma and/or grease barrier, it is essential that the coating is uniform and thick enough to provide a pin hole free coating or barrier.

One problem with techniques carried out on dry fibrous webs is that the surface treatment rewets the surface and hence dimensional stability and coating quality is much dependent on the base substrate-coating interaction. This is a particular problem for hydrophilic substrates such as cellulose-based substrates where both hydrophilicity and porosity cause high water or liquid uptake during the application and levelling of the coating, which is usually water- or aqueous-based.

Also, another problem is that coating is mainly made for adjusting the appearance or end product performance, not for improving e.g. the web manufacturing process (in which on-line coating puts extra requirements on the technical properties of the web in order to avoid e.g. web breaks etc.). Another problem is that dosing small amounts of chemicals to thin fibrous webs such as cellulose films or greaseproof papers can be very difficult in terms of creating an even coating due to the aforementioned challenges.

SUMMARY

A method is provided for coating a fibrous web, said method comprising the steps of:

a. providing a textured substrate, having at least one textured surface region,
b. applying a coating agent to the textured surface region of said textured substrate, so as to provide a coated textured surface region of said textured substrate;
c. applying a fibre furnish onto the coated, textured surface region of said textured substrate; and dewatering said fibre furnish to provide a wet fibrous web, or,
d. applying a wet fibrous web onto the coated, textured surface region of said textured substrate;
e. drying said wet fibrous web from step c. or step d. such that at least a portion of said coating agent is transferred to said fibrous web, and
f. removing the coated fibrous web from said textured surface region, thereby providing a coated fibrous web.

Additional aspects of the technology are described in the following claims and description text.

LEGENDS TO THE FIGURES

FIG. 1 shows a wet fibrous web (10) on the textured surface region (21) of a textured substrate (20)—in this case a textured belt—having a coating (30), which is dewatered and dried to provide a coated fibrous web (100) with a coating (300).

DETAILED DISCLOSURE

A general method for coating a fibrous web is provided, said method comprising the steps of:

a. providing a textured substrate having at least one textured surface region,
b. applying a coating agent to the textured surface region of said textured substrate, so as to provide a coated textured surface region of said textured substrate;
c. applying a fibre furnish onto the coated, textured surface region of said textured substrate; and dewatering said fibre furnish to provide a wet fibrous web, or,
d. applying a wet fibrous web onto the coated, textured surface region of said textured substrate;
e. drying said wet fibrous web from step c. or step d. such that at least a portion of said coating agent is transferred to said fibrous web, and
f. removing the coated fibrous web from said textured surface region, thereby providing a coated fibrous web.

Advantages which may be obtained with the current technology include:

Online coating, single or multilayer coating; if more than one textured substrate is used in sequence, then it would be possible to apply several coating agents.

Controlled adhesion with the textured surface region of the textured substrate (control of dimensional stability, shrinkage)

Thin coating (e.g. 0.1 to 100 gsm, preferably 0.3 to 50 gsm, more preferably 0.5 to 20 gsm dry weight)

Extended nip; i.e. the contact time between coating and fibrous web is long when this method is used. The contact time is preferably longer than normally used in traditional coatings.

Improved barrier properties; i.e. at least one of gas barrier, water vapor barrier, aroma barrier or oil and grease barrier Tailored homogenous or heterogeneous (uneven) coating of one side of the fibrous web A textured substrate is provided, which is suitably a textured belt or a textured cylinder. By utilizing a textured substrate, the amount of coating can be controlled more accurately, without problems associated with excess coating liquid in nips etc. The use of a textured substrate provides further advantages such as better profile control (machine direction) and the possibility to make textured pattern on the receiving web. The textured substrate has at least one textured surface region.

In the present technology, the term "textured substrate"—means that a surface region of said substrate has a predetermined texture (i.e. it is a textured surface). The texture of the textured surface region is non-random, and thus is distinguished from surfaces/surface regions/substrates which may be ground or otherwise treated to obtain a substantially random texture. Suitably, the textured surface region has a predetermined, repeating texture, in which a pattern repeats regularly. The textured surface region may comprise the entirety of the surface of the substrate; e.g. the entire width of the substrate in the cross-machine direction, and/or the entire length in the machine direction. Alternatively, the textured surface region only comprises a part of the surface of the substrate, and other non-textured surface regions may be present, e.g. at the edges of the substrate in the cross-machine direction, and/or intermittently in the machine direction.

The fibre furnish or the wet fibrous web may thus be applied also outside the textured surface region, i.e. such that for example a coated fibrous web is formed which has edge areas which are uncoated. In other words, the application area of the fibre furnish or the wet fibrous web may be wider/larger than the textured surface region.

In one embodiment, the "textured surface region" comprises a repeating pattern of recessed regions and at least one non-recessed region arranged between said recessed regions, wherein each recessed region is recessed a depth d from the adjacent non-recessed region(s), said depth d being determined in a direction perpendicular to the surface of said textured substrate, said depth d may be between 1-100 μm.

The textured substrate can be made of metal or plastic, or combinations of suitable materials, i.e. the textured substrate may be a textured belt such as a metal belt, a polymer belt or a ceramic belt, or a composite belt. A textured substrate such as a textured belt may have a length of 1-300 m and a width of 0.2-10 m. The textured surface region of the textured substrate might also be coated with e.g. a ceramic or plastic coating e.g. to adjust surface energy. Typically, the textured surface region of the textured substrate comprises a plurality of recesses such that the textured surface region has a cell volume of 0.5-1000 $cm^3/m^2$, preferably 1-500 $cm^3/m^2$ and more preferably 1-100 $cm^3/m^2$.

A pattern of recesses can be provided in the textured surface region by etching non-conducting or conducting channels or cells. It is also possible to deposit material to create protruding areas. One example is to use laser technology for engraving the textured belt or textured cylinder.

By using a textured surface region in the manner described, it becomes possible to provide a thin, even coating on a fibrous web.

A coating agent is applied to the textured surface region of the textured substrate. The coating agent typically comprises one or more coating components selected from waxes, oils, polar lipids, metallic soaps, rosins or mixtures thereof. In one preferred aspect, the coating component is an alkyl ketene dimer (AKD) or a fatty acid resin.

Examples of waxes include microcrystalline waxes such as e.g. paraffin waxes or polyethylene, polypropylene (PP), other natural or synthetic waxes and wax emulsions thereof. The waxes can be either fossil-based, natural-based or bio-based such as beeswax, carnauba wax, or bio waxes (TopScreen™, from Solenis).

Examples of oils are vegetable oils. Examples of polar lipids are fatty acids or triglycerides, such as stearic acids, lauric acids, oleic acids, etc.

Examples of rosins are e.g., emulsions, emulsion sizes (i.e. rosin acids dissolved, dispersed, diluted, etc., with an emulsifier or stabilizer such as casein or other cationic polyelectrolyte to form a liquid), or rosin soap sizes.

The coating component can be non-reactive or reactive. Reactive coating components may include one or more alkyl ketene dimers (AKDs) or alkenyl succinic acid anhydrides (ASAs).

The coating agent may be a water in oil (W/O) emulsion or an oil in water (O/W) emulsion, but an O/W emulsion is preferred. The coating agent is typically in the form of an O/W emulsion comprising one or more of the coating components set out above. Particularly preferred O/W emulsions include O/W emulsions of styrene acrylate, styrene butadiene, or polyvinyl acetate, or mixtures thereof. The aqueous emulsions usually contain emulsifying agents, stabilizing agents and further additives such as biocides or preservatives. The preferred average particle size for the emulsions is between 10-5000 nm, preferably 50-500 nm.

In a particular embodiment, the coating agent is a micro- or nano-emulsion, comprising for example fatty tri-esters and/or hydrolyzed AKDs. The coating agent suitably comprises one or more adhesion agents such as a cationic polymer.

Use of a coating agent in this manner enables controlled adhesion with the textured surface region (control of dimensional stability, shrinkage), while only applying a thin coating.

The coating agent is suitably applied to the textured surface region in an amount of 0.1-100 gsm, preferably 0.3-50 gsm and more preferably 0.5-20 gsm. The coating agents can be applied on the textured surface region and then heated to temperatures between 40° C. and 400° C., preferably 60-240° C. and most preferably 80-180° C., depending on the coating agent and the grade used. The melting point for the coating component is preferably in the range of −40° C. to +160° C., suitably from +30° C. to +160° C.

In one aspect, the fibrous web comprises 0.01-100 gsm or more preferably 0.1-50 gsm of the coating agent once applied and dried.

In one embodiment, the coating agent is applied to the textured surface region before the fibre furnish. Preferably the coating method for application of the coating agent is spray application, curtain application, roll applicator, printing, dipping, etc. Preferably, the coating comprises at least one application step and one levelling step. A levelling step means removal of excess coating liquid, e.g. via a doctor blade or a rod.

Preferably, prior to application of the coating agent, the textured surface region can be cleaned with e.g. spray systems or steam in order to ensure that it is clean.

A fibre furnish may be applied onto the coated textured surface region of said textured substrate, in a casting step. The fibre furnish is then dewatered to provide a wet fibrous web. The fibre furnish may be cast formed on the coated textured surface region of the textured substrate. In this case, cast forming means that the fibre furnish is deposited onto the textured surface region (indirectly or directly) by using preferably a non-contact deposition method. Cast forming may include various methods to apply the wet furnish to the surface region, such as curtain or slot die type of feeding, spray, roll or rod, etc.

Dewatering is a process that preferably takes place via both mechanical dewatering such as mechanical pressing or filtering and by evaporating. Mechanical dewatering is of course preferred since it removes water more cost efficiently than evaporation. Also, a mechanical dewatering ensures that the contact to the textured surface region is good and that the texture of the surface region may be copied to the film or web. Another benefit of mechanical dewatering is that the applied pressure (negative or positive) densify the web, which promotes the final barrier properties. Dewatering can take place at elevated temperature, although most water is removed mechanically. Vacuum or capillary-based dewatering can also be used separately or simultaneously as the mechanical dewatering. The dewatering step can also be boosted by applying acoustic or ultrasound methods. The mechanical dewatering has also its limitation and therefore the remaining water is preferably removed by evaporating. In this case, the substrate is heated by radiation or convection or by applying hot air or steam.

The preferred dry content of the fibre furnish when applied to the textured surface region is preferably 0.1-50 wt % or more preferably 0.5-30 wt % and most preferably 1-25 wt %. In one embodiment the dry content of the fibre furnish when applied to the textured surface region is 0.1-30 wt % or 1-20 wt % or 1-15 wt % or 1-10 wt %.

An alternative to applying a fibre furnish to the textured surface region is applying a wet fibrous web onto the coated textured surface region of said textured substrate. In this alternative, the wet fibrous web is already formed when applied to the textured surface region. This alternative allows greater freedom in the web formation procedure.

The dry content of the wet fibrous web when applied to the textured surface region is preferably 5-90 wt % or more preferably 8-80 wt % and most preferably 10-60 wt %. A wet or moist web has preferably a given wet strength so it can be transferred from a forming unit to a press and drying section.

In one embodiment, the fibre furnish is an aqueous suspension of cellulosic fibres, typically nanocellulosic fibres. In one embodiment, therefore, the fibrous web comprises cellulosic fibres, preferably nanocellulose fibres.

The present invention provides a web, which may comprise cellulosic fibres, preferably nanocellulose (i.e. a nanocellulosic web). Nanocellulose shall, in the context of the present technology mean a nano-scale cellulose fibre or fibril with at least one dimension, preferably diameter, less than 1000 nm. A nanocellulose suspension might also comprise partly or non-fibrillated cellulose or lignocellulose fibres. The cellulose fibre is preferably fibrillated to such an extent that the final specific surface area of the formed nanocellulose is from about 1 to about 300 $m^2/g$, such as from 10 to 200 $m^2/g$ or more preferably 50-200 $m^2/g$ when determined for a solvent exchanged and freeze-dried material with the BET method. The mean average fibril diameter of the nanocellulose is 1-1000 nm, preferably 10-1000 nm. The nanocellulose may be characterised by analysing high resolution SEM or ESEM images.

The fibrous web may comprise nanocellulose in an amount of between 0.01-100 wt % based on total solids content of the web. Suitably, the nanocellulose content in the web is at least 50 wt %, preferably at least 60 wt % and more preferably at least 70 wt % based on total solids content of the web, without any coating. In an embodiment, the nanocellulose web comprises at most 50 wt %, such as at most 30 wt %, suitably at most 20 wt % of partly or non-fibrillated cellulose or lignocellulose fibres, having a mean average fibril diameter greater than 1000 nm, based on total solids content.

Various methods exist to make nanocellulose, such as single or multiple pass refining, pre-hydrolysis followed by refining or high shear disintegration or liberation of fibrils. One or several pre-treatment steps are usually required in order to make nanocellulose manufacturing both energy-efficient and sustainable. The cellulose fibres of the pulp to be supplied may thus be pre-treated enzymatically or chemically, for example to reduce the quantity of hemicellulose or lignin. The cellulose fibres may be chemically modified before fibrillation, wherein the cellulose molecules contain functional groups other (or more) than found in the original cellulose. Such groups include, among others, carboxymethyl, aldehyde and/or carboxyl groups (cellulose obtained by N-oxyl mediated oxidation, for example "TEMPO"), or quaternary ammonium (cationic cellulose). After being modified or oxidized in one of the above-described methods, it is easier to disintegrate the fibres into nanocellulose.

The nanocellulose may contain some hemicelluloses; the amount is dependent on the plant source. Mechanical disintegration of the pre-treated fibres, e.g. hydrolysed, pre-swelled, or oxidized cellulose raw material is carried out with suitable equipment such as a refiner, grinder, homogenizer, colloider, friction grinder, ultrasound sonicator, single—or twin-screw extruder, fluidizer such as microfluidizer, macrofluidizer or fluidizer-type homogenizer. Depending on the nanocellulose manufacturing method, the product might also contain fines, or nanocrystalline cellulose or e.g. other chemicals present in wood fibres or in papermaking process. The product might also contain various amounts of micron size fibre particles that have not been efficiently fibrillated.

Nanocellulose can be produced from wood cellulose fibres, both from hardwood or softwood fibres. It can also be made from microbial sources, agricultural fibres such as wheat straw pulp, bamboo, bagasse, or other non-wood fibre sources. It is preferably made from pulp including pulp from virgin fibre, e.g. mechanical, chemical and/or thermomechanical pulps. It can also be made from broke or recycled paper, i.e. pre and post-consumer waste.

The nanocellulose can be native (i.e. chemically unmodified), or it can be chemically modified. Phosphorylated nanocellulose is typically obtained by reacting cellulose fibres soaked in a solution of $NH_4H_2PO_4$, water and urea and subsequently fibrillating the fibres. One particular method involves providing a suspension of cellulose pulp fibres in water, and phosphorylating the cellulose pulp fibres in said water suspension with a phosphorylating agent, followed by fibrillation with methods common in the art. Suitable phosphorylating agents include phosphoric acid, phosphorus pentaoxide, phosphorus oxychloride, diammonium hydrogen phosphate and sodium dihydrogen phosphate.

The web, and the resulting fibre furnish, may also include other cellulosic components.

One advantage of nanocellulosic webs is that they can be transparent to visible light. Preferably, therefore, the nanocellulosic web has a transparency of more than 70% preferably more than 75% and more preferably more than 80% when measured for a web with grammage of ca 30 gsm, measured according to the standard DIN 53147. Note that the nanocellulosic web can have high transparency for visible light but poor transparency for UV light. The transparency might, however, be affected by the coating.

The web/fibre furnish may also comprise one or more fillers, such as a nanofiller, in the range of 1-30% by weight based on total solids content of the web, without any coating. Typical nanofillers can be nanoclays, bentonite, silica or silicates, calcium carbonate, talcum, etc. Preferably, at least one part of the filler is a platy filler. Preferably, one dimension of the filler should have an average thickness or length of 1 nm to 10 μm. If determining the particle size distribution of fillers for example with light scattering techniques, the preferred particle size should be that more than 90% is below 2 μm.

The web/fibre furnish may also contain strengthening agents such as cellulose derivatives or native starch or modified starch such as, for example, cationic starch, nonionic starch, anionic starch or amphoteric starch. The strengthening agent can also be synthetic polymers. In a further embodiment, the nanocellulosic web/fibre furnish may also contain retention and drainage chemicals such as cationic polyacrylamide, anionic polyacrylamide, silica, nanoclays, alum, PDADMAC, PEI, PVAm, etc. In yet a further embodiment, the web/fibre furnish may also contain other typical process or performance chemicals such as dyes or fluorescent whitening agents, defoamers, wet strength resins, biocides, hydrophobic agents, barrier chemicals, plasticizers, humectants, etc. The viscosity of the suspension is preferably higher than 20 cP, more preferably higher than 40 cP or most preferably higher than 60 cP when measured with Brookfield viscosimeter at 100 rpm at 40° C. Higher viscosity (at higher temp) reduces or prevents intermixing between the wet web (furnish) and coating layer on the surface.

The pH of the fibre furnish is not limited but is preferably 4-10 and more preferably 5-9. Casting of the fibre furnish on the coated surface region of the textured substrate suitably takes place at a temperature of 10-90 OC and more preferably 20-70 OC.

The web/fibre furnish may comprise cationic or anionic nanocellulose; such as carboxymethylated nanocellulose. In an embodiment, the cationic or anionic nanocellulose is present in an amount of less than 50 wt % of the total amount of nanocellulose, preferably in an amount of less than 40 wt %, or more preferably in an amount of less than 30 wt %.

The fibrous web has a grammage when dry of between 1-80 gsm, preferably between 10-50 gsm, such as e.g. 10-40 gsm. For certain applications, the grammage can be low, e.g. 0.1-20 gsm or more preferably even 0.1-10 gsm.

The wet fibrous web (from either of the foregoing alternatives) is then dried such that at least a portion of said coating agent is transferred to said fibrous web. This is illustrated generally in FIG. 1. The drying step may take place at a temperature greater than 60 OC, preferably greater than 80 OC and more preferably greater than 90 OC and at a temperature of less than 400 OC. The drying step suitably takes place at a temperature above the melting point of at least one of the coating components, e.g. above the melting point of the waxes, rosins, alkyl ketene dimers or fatty acid resins. The preferred temperature range is such that the coating component migrates to the fibrous web.

Depending on the process parameters, the fibrous web may obtain some texture from the textured surface region. Therefore, in one aspect of the method according to the invention, the coated fibrous web is a coated textured fibrous web. Process parameters influencing the provision of texture to the fibrous web from the textured surface region (physical texture effect) or not may be e.g. the contact time between the textured surface region and the fibrous web, drying temperature, use of mechanical dewatering, the amount of coating agent and the type of coating agent. For example, if recesses of the texture of the textured surface region are fully covered/filled by a coating agent, the physical texture effect may be less obvious. However, if recesses of the texture of the textured surface region are not fully covered/filled (such as e.g. covered/filled by 50%) by a coating agent or with a very low viscous chemical, it may be possible to get both a chemical and physical texture effect.

Thus, depending on the process parameters, the fibrous web may not, or essentially not, obtain any texture from the textured surface region, but the texture of the textured surface region is only, or mainly, utilized for enabling provision of an improved coating, e.g. thin, even coating, on the fibrous web. Thus, in another aspect of the method according to the invention, the coated fibrous web is a coated fibrous web without any texture obtained from the textured surface region (i.e. without any texture obtained by physical texture effect). However, the coating may provide a uniform or textured chemical effect.

The fibre furnish or wet fibrous web is suitably in contact with the textured surface region, for a length in the machine direction of at least 2 m, preferably at least 5 m, to ensure proper contact and transfer of the coating agent. Such contact is made with the aid of external pressure, such that at least one press or dewatering fabric can be used to simultaneously dry the web.

The contact time between the coating agent and the fibrous web is long when this method is used. Suitably, the nip length is more than 0.2 m preferably more than 0.5 m and most preferably more than 1.0 m. This provides a so-called "extended nip" or contact time between the coating agent and the fibrous web. In all traditional impact coating, the coating impact length/time is very short.

Finally, the coated fibrous web is removed from said textured surface region, thereby providing a coated fibrous web. The amount of coating agent that is then transferred to the web depends on coating agent, drying method etc. For example, the amount of coating agent transferred to the web may be 20-100% or 20-99% or 20-90% or 20-80% or 30-70% of the coating agent applied to the textured surface region. Thus, the amount of coating agent transferred to the web may be, for example, 100%, 99%, 90%, 80% or 70% of the coating agent applied to the textured surface region.

The fibrous web typically has a width in the cross direction of the textured substrate which is greater than 500 mm, preferably greater than 1000 mm and more preferably greater than 1500 mm. The coated fibrous web is suitably transparent or translucent.

The resulting coated fibrous web should have at least one barrier property selected from UV barrier, oil and grease barrier, oxygen barrier, aroma barrier and water vapor barrier, or combinations thereof. The fibrous web may be a film, i.e. the resulting product may be a cellulose film such as a nanocellulose film.

The technique is applicable for nanocellulose web manufacturing or if using extended nip (belt) dewatering or calendaring of a web which preferably contains nanocellulose. It can also be used for other cellulose based webs.

The excess coating agent may be removed from the textured surface region prior to step c or step d of the method according to the present invention, for example using a rod or doctor blade.

Although the present invention has been described in relation to a number of embodiments, these are not to be considered limiting for the invention. The skilled person may provide other embodiments falling within the claims by combining various aspects and embodiments as required.

The invention claimed is:

1. A method for coating a fibrous web, said method comprising the steps of:

a. providing a textured substrate having at least one textured surface region, b. applying a coating agent to the textured surface region of said textured substrate, so as to provide a coated, textured surface region of said textured substrate;

c. applying a fibre furnish onto the coated, textured surface region of said textured substrate; and dewatering said fibre furnish to provide a wet fibrous web, or, d. applying a wet fibrous web onto the coated, textured surface region of said textured substrate;

e. drying said wet fibrous web from step c. or step d. such that at least a portion of said coating agent is transferred to said fibrous web, and f. removing the fibrous web from said textured surface region after step e., thereby providing a coated fibrous web.

2. The method according to claim 1, wherein said textured surface region has a predetermined texture.

3. The method according to claim 1, wherein the fibrous web comprises cellulosic fibres.

4. The method according to claim 1, wherein said textured substrate is a textured belt.

5. The method according to claim 1, wherein said fibre furnish or said wet fibrous web is in contact with the coated textured surface region of said textured substrate for a length in a machine direction of at least 2 m.

6. The method according to claim 1, wherein the coating agent comprises one or more coating components selected from a group consisting of waxes, oils, polar lipids, metallic soaps, rosins, and mixtures thereof.

7. The method according to claim 1, wherein the coating agent comprises one or more coating components being an alkyl ketene dimer (AKD) or a fatty acid resin.

8. The method according to claim 1, wherein the coating agent is a water in oil (W/O) emulsion or an oil in water (O/W) emulsion.

9. The method according to claim 1, wherein the coating agent comprises one or more adhesion agents.

10. The method according to claim 1, wherein the fibrous web comprises nanocellulose in an amount of between 0.01-100 wt % based on a total solids content.

11. The method according to claim 1, wherein the textured surface region comprises a plurality of recesses such that the textured surface region has a cell volume of 0.5-1000 $cm^3/m^2$.

12. The method according to claim 1, wherein the drying step takes place at a temperature above a melting point of at least one component of the coating agent.

13. The method according to claim 1, wherein the drying step takes place at a temperature greater than 60° C. and at a temperature of less than 400° C.

14. The method according to claim 1, wherein said coated fibrous web is transparent or translucent.

15. The method according to claim 1, wherein said coated fibrous web is a coated, textured fibrous web.

16. The method according to claim 1, wherein the coating composition is applied to the textured surface region in an amount of 0.1-100 gsm by dry weight.

17. The method according to claim 1, wherein said coated fibrous web has at least one barrier property selected from a group consisting of: UV barrier, oil and grease barrier, oxygen barrier, aroma barrier, water vapour barrier, and combinations thereof.

18. The method according to claim 1, wherein the fibrous web has a width, in a cross direction of the textured substrate, which is greater than 500 mm.

19. The method according to claim 1, wherein excess coating agent is removed from the textured surface region prior to step c or step d.

* * * * *